United States Patent [19]

Emmert

[11] Patent Number: 4,610,056

[45] Date of Patent: Sep. 9, 1986

[54] QUICK CONNECT AND RELEASE BUCKLE

[76] Inventor: Raymond L. Emmert, 8028 NW. 20, Oklahoma City, Okla. 73127

[21] Appl. No.: 668,531

[22] Filed: Nov. 5, 1984

[51] Int. Cl.[4] ..... A44B 11/12

[52] U.S. Cl. ..... 24/197; 24/193; 24/198

[58] Field of Search ..... 24/197, 310, 700, 68 CD, 24/68 E, 19, 115 H, 68 F, 16, 193, 200, 196, 194

[56] References Cited

U.S. PATENT DOCUMENTS

| | | | |
|---|---|---|---|
| 705,620 | 7/1902 | Specht | 24/198 |
| 2,769,220 | 11/1956 | Harley | 24/193 |
| 3,060,537 | 10/1962 | Hatfield | 24/197 |
| 3,192,586 | 7/1965 | Marley | 24/196 |
| 3,372,440 | 3/1968 | Burson, Jr. . | |
| 3,696,471 | 10/1972 | Mermelstein | 24/193 |

FOREIGN PATENT DOCUMENTS

| | | | |
|---|---|---|---|
| 34072 | 1/1965 | Finland | 24/193 |

*Primary Examiner*—William E. Lyddane
*Assistant Examiner*—Laurie K. Cranmer
*Attorney, Agent, or Firm*—Robert K. Rhea

[57] ABSTRACT

A belt buckle comprising two unitary plate metal parts, each having an opening for attaching the ends of a belt thereto. One buckle part defines and arcuate tongue, having a part cylindrical recess therein, for receiving a latch bar formed on the other part with the plane of the latch bar inclined to prevent accidental separation of the buckle parts. A belt clamp bar, on the belt part opposite the tongue, grips a doubled back end portion of the belt for adjusting the belt length and tension.

4 Claims, 5 Drawing Figures

QUICK CONNECT AND RELEASE BUCKLE

BACKGROUND OF THE INVENTION

1. Field of the Invention

The present invention relates to belt or strap buckles and more particularly to a quick connect and release buckle.

This buckle has particular application in industry where an industrial stilt leg stabilizing tube is secured to the leg of the user by a fabric strap. This buckle permits ease of adjusting the belt tension and will not become unbuckled as a result of looseness of the strap around the user's leg.

2. Description of the Prior Art

In a conventional belt buckle a metallic loop is fastened to one end of the belt to slidably receive the other end portion of the belt when threaded therethrough. The belt is secured by a tongue or catch, supported by the loop, entering one of a plurality of longitudinally spaced holes in the belt. Such a buckle has the disadvantage of the necessity of threading the apertured end portion of the belt through the buckle and a further disadvantage that the hole spacing is usually not such that a desired tension of a belt, about the user's leg, for fastening an industrial stilt can be achieved. Further, such belt buckles are not quickly and easily disconnected for removing the stilts and some times when loose become unbuckled unless the free end of the belt is secured.

Prior patents generally disclose other type of belt or strap buckles, such as those presently used with safety seat belts. While these buckles perform a function similar to the present invention they have the disadvantage of comprising a plurality of parts and thus are not economically attractive in many industrial applications.

The most pertinent prior patent is believed to be U.S. Pat. No. 3,372,440 which discloses confronting sections of a safety belt buckle in which opposing end portions of a belt are adapted to be looped through the respective section in overlapping relation to achieve belt tightness or adjustment thereof. One of the sections is formed by superposed planar parts in which one end portion of the two parts are arcuately curved toward each other to provide a cavity therebetween. The other section is similarly formed from two planar parts transversely hingedly connected in superposed relation with the uppermost part having a recess or trough therein threaded into the cavity formed by the adjacent end portions of the other section.

The buckle of the present invention is distinctive over the prior art, including the above named patent, by providing two buckle parts in which the end of one part defines a slot-like entryway to a recess permitting free passage of a latch bar side of a loop formed on the adjacent end portion of the other part when disposed at a predetermined angle.

SUMMARY OF THE INVENTION

The buckle comprises two unitary generally rectangular plate metal parts, adapted to be connected with the respective end portions of a belt. A transverse tongue is formed on the end of one part confronting the other part in which the tongue is arcuately doubled back upon itself to define an open end part cylindrical recess having a slot-like entryway opposite the position of the other part.

The other buckle part is generally open frame-like having opposing parallel sides transversely spanned by a belt loop receiving bar. One end of the frame sides is transversely joined by a latch bar for entering the tongue transverse recess to secure the buckle parts together. The opposite end of the frame sides is spanned by a belt clamp bar releasably impinging a belt loop when entrained around the belt loop bar. The clamp bar is provided with a tongue portion opposite the latch bar for adjusting the belt length and tilting the buckle frame part for latching and unlatching the buckle.

The principal objects of this invention are to provide a two part belt buckle which can be quickly and easily latched and released in which the possibility of accidental release is minimized with the latching and releasing action accomplished by manually tilting one part with respect to the other which also permits tightening or loosening the belt by moving one part toward a release position and which secures the belt under desired tension.

DESCRIPTION OF THE PREFERRED EMBODIMENT

Figure 3:
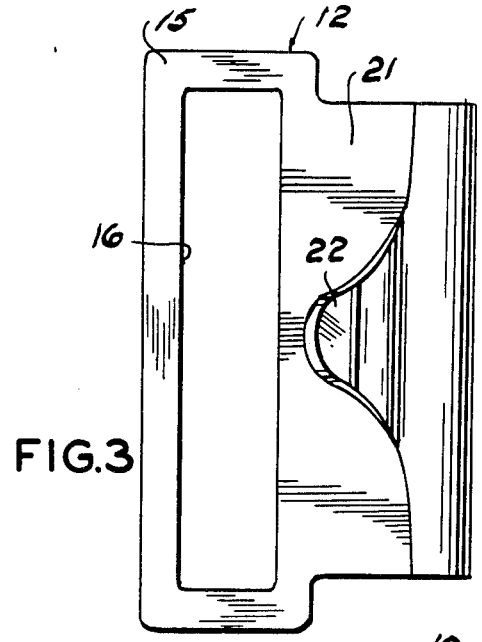
FIG. 3 is an elevational view of the hook buckle part.
Figure 2:
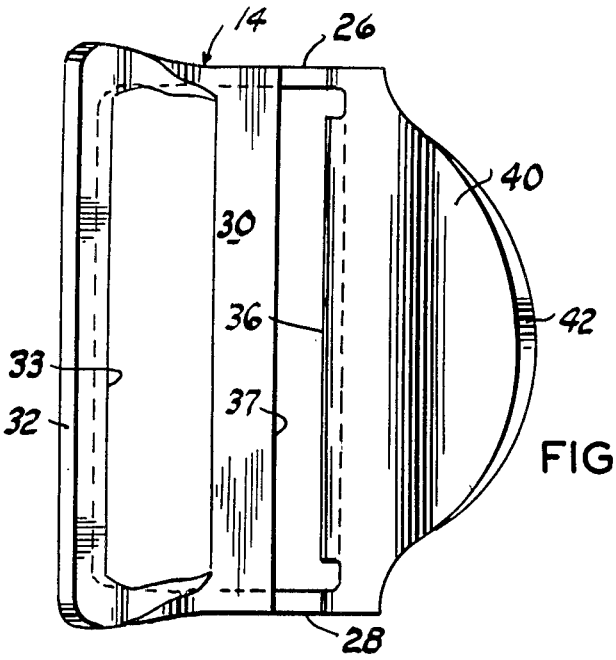
FIG. 2 is an elevational view of the latch buckle part.

Like characters of reference designate like parts in those figures of the drawings in which they occur.

In the drawings:

The reference numeral 10 indicates the buckle as a unit which is generally rectangular. The buckle comprises a hook part or section 12 and a latch part or section 14. The part 12 is formed from plate metal with one end portion 15 apertured to form a transverse opening or loop 16 for attaching one end portion 18 of a belt thereto, as by rivets 20, or the like. The other end portion of the part 12 forms a tongue 21 transversely reduced in dimension to substantially equal the length of the opening 16 with its free end surface converging to define a planar tongue tip 22, for the purpose presently explained. The end portion of the tongue 21 opposite the opening 16 is arcuately curved back upon itself, intermediate its ends, to define a part cylindrical recess 24 open at its respective ends and toward the loop 16 with the tip 22 lying in an inclined plane defining an angle A of preferably 30° with respect to the plane of the end portion 15.

The other part 14, similarly formed from plate metal, is open frame-like having opposing generally vertical parallel sides 26 and 28 transversely joined by an overlying belt end loop bar 30. The forward end of the sides 26 and 28 is joined by a transverse latch bar 32 spaced forwardly of the belt loop bar 30 to define a tongue and belt receiving opening 33. The latch bar 32 is rectangular in transverse section and is preferably inclined with respect to the plane of the belt loop bar 30 and the plane of the depending surface 34 of the sides 26 and 28 on an angle B of preferably 60° for the purposes presently explained. The diagonal dimension of the rectangular configuration of the latch bar 32 is slightly less than the diameter of the part circular recess 24 and substantially greater than the spacing between the tip 22 and the planar portion of the tongue 21 for the reasons presently apparent. Similarly, the thickness of the latch bar 32 is preferably substantially less than the spacing between the lip 22 and the tongue planar portion.

The other or rearward end portion of the sides 26 and 28 are transversely spanned by a belt clamp bar 36, spaced rearwardly from the belt loop bar 30 to form a belt receiving opening 37. The clamp bar 36 is disposed normal to the plane of the belt loop bar 30 and terminates upwardly, as viewed in the drawings, with respect to the plane of the depending surface or edge 34 of the sides to form a belt gripping surface 38. The clamp bar 36 is integrally joined to a clamp bar release tongue 40, having an arcuate rear edge 42, turned arcuately upward with respect to the plane of the belt loop bar 30.

Figure 1:
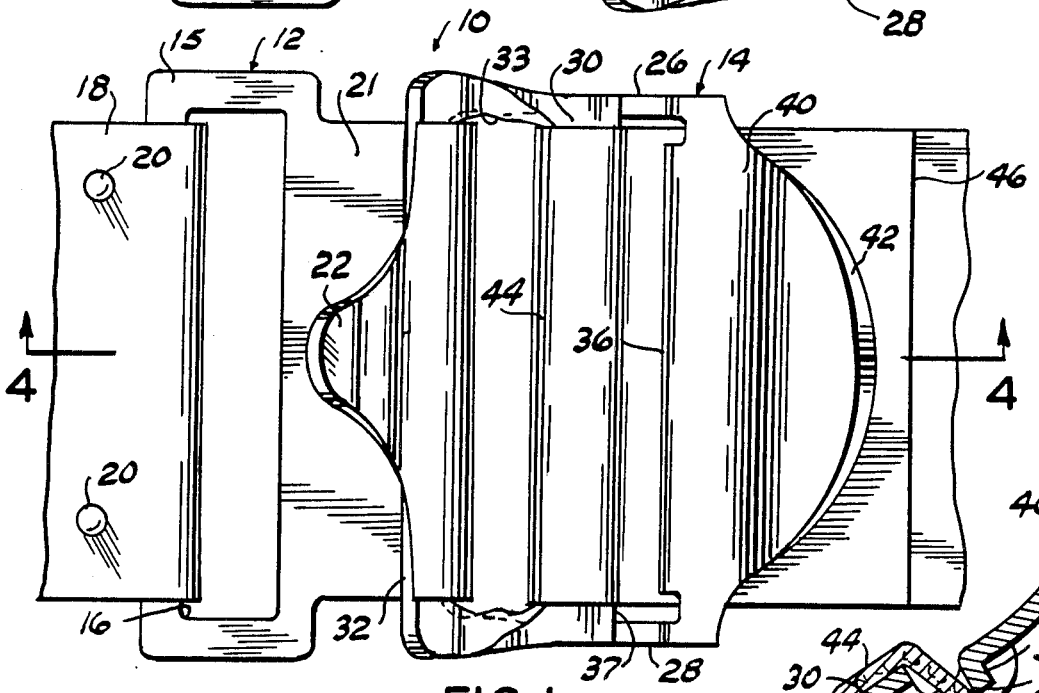
FIG. 1 is an elevational view of the buckle in latched position connected with fragmentary ends of a belt.
Figure 4:
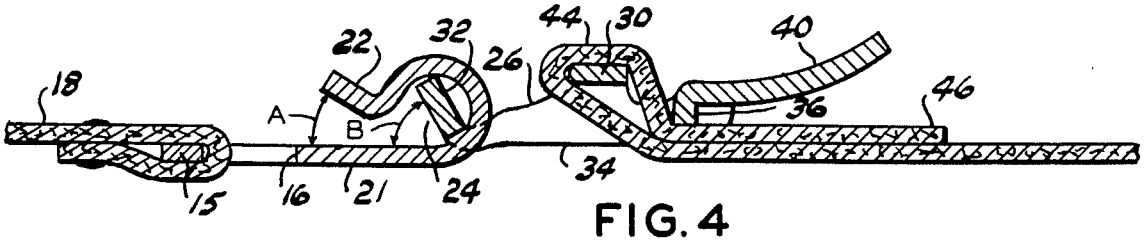
FIG. 4 is a vertical cross sectional view taken substantially along the line 4—4 of FIG. 1; and, FIG. 5 is a view similar to FIG. 4 illustrating the relative position of the buckle parts while latching or releasing the buckle.

The other end portion 44 of the belt is connected with the part 14 by inserting the belt free end 46 upwardly, as viewed in the drawings, through the opening 33 and entraining the free end over the loop bar 30 and downwardly through the opening 37 to contiguously overlie the adjacent end portion of the belt wherein the belt clamp bar surface 38 frictionally grips the belt loop end portion when the belt buckle is latched, as illustrated by FIGS. 1 and 4.

OPERATION

Figure 5:
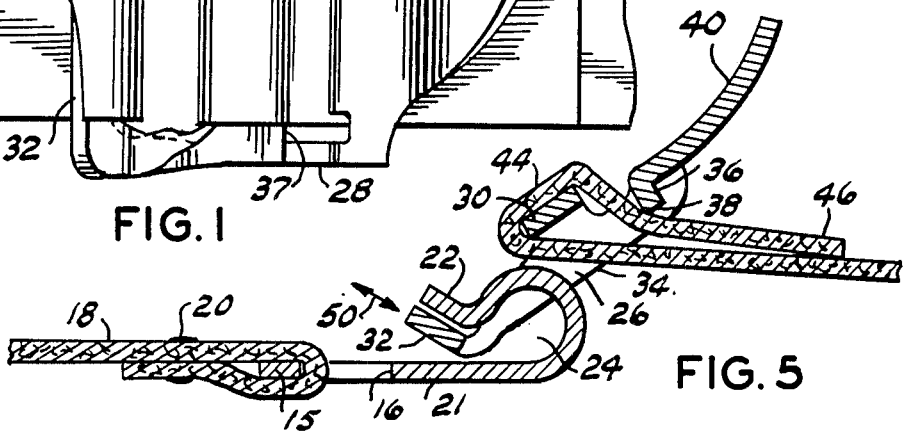

In operation, the belt is secured, intermediate its ends, in a conventional manner to a stilt supporting leg, not shown. The belt surrounds a user's leg between his knee and ankle and is secured by tilting or pivoting the buckle part 14 about the longitudinal axis of the latch bar 32, accomplished by manually grasping the clamp tongue 40, to move the clamp bar tongue outwardly from the user's leg and dispose the plane of the latch bar 34 complemental with the plane of the lip 22, as shown by FIG. 5. The latch bar may then be moved into the recess 24 in the direction shown by the arrow 50.

Similarly, the buckle is released by moving the latch bar outwardly from the recess after pivoting it to the FIG. 5. position. When in the position of FIG. 5, the belt end portion 44 may be slid around the loop bar 30 by a manual pull on the free end portion 46 to achieve the desired belt tension. When the buckle is latched, as illustrated by FIG. 4, the edge surfaces of the latch bar 32 contacts the inner wall surface of the part cylindrical recess to prevent movement of the buckle parts toward and away from each other.

Obviously the invention is susceptible to changes or alterations without defeating its practicability. Therefore, I do not wish to be confined to the preferred embodiment shown in the drawings and described herein.

I claim:

1. A quick connect and release buckle, comprising:

two parts formed from planar material, one said part having a planar end portion;

means for attaching a belt to each part;

a tongue at the other end portion of said one part arcuately curved back upon itself and forming an arcuate end wall defining a part-cylindrical recess, open at both sides of the tongue, and a slot-like opening adjacent said planar end portion and terminating in a planar tip, medially the width of the tongue, having arcuate side surfaces merging into an arcuate end surface with the plane of the tip inclined on an acute angle with respect to the plane of said planar end portion; and, a transverse planar latch bar disposed at one side of a buckle tongue receiving opening in one end portion of the other said part, said latch bar being adapted for entering the part-cylindrical recess through the slot-like opening when the plane of the latch bar is disposed substantially parallel with the plane of said planar end portion, said latch bar being cooperatively nested by the part-cylindrical recess with the plane of the latch bar normally inclined with respect to the plane of said tip when said two parts are operably engaged, said latch bar having a transverse cross section dimension greater than the transverse dimension of the slot-like opening and slightly less than the diameter of the part-cylindrical recess for normally preventing buckle releasing movement of one part toward or away from the other part when said two parts are operably engaged.

2. The buckle according to claim 1 in which said belt attachment means includes:

an opening formed in the end portion of said one part opposite said tongue for receiving one end portion of a belt.

3. The buckle according to claim 1 in which said belt attachment means includes:

a belt loop bar on said other part parallel with and spaced from said latch bar in a direction opposite said one part around which an end portion of a belt is entrained; and, belt clamp bar means on said other part parallel with and spaced from said belt loop bar in a direction opposite said one part for normally preventing sliding movement of a belt end portion relative to said belt loop bar.

4. The buckle according to claim 3 in which said belt clamp bar means includes:

a clamp bar having an end surface projecting toward the adjacent surface of a belt end portion when entrained around said belt loop bar, said clamp bar terminating in a clamp bar tongue portion projecting in a direction opposite said one part.

* * * * *